US005943731A

United States Patent [19]

Wood

[11] Patent Number: 5,943,731

[45] Date of Patent: Aug. 31, 1999

[54] ACCESSORY HOLDER FOR VACUUM CLEANER

[75] Inventor: Steve Wood, Cadillac, Mich.

[73] Assignee: Rexair, Inc., Troy, Mich.

[21] Appl. No.: 09/021,610

[22] Filed: Feb. 10, 1998

[51] Int. Cl.[6] ..... A47L 9/00

[52] U.S. Cl. ..... 15/323; 15/339

[58] Field of Search ..... 15/323, 339

[56] References Cited

U.S. PATENT DOCUMENTS

| | | | |
|---|---|---|---|
| D. 294,755 | 3/1988 | Lackner et al. . | |
| D. 294,756 | 3/1988 | Fonville . | |
| D. 295,334 | 4/1988 | Fonville . | |
| D. 295,910 | 5/1988 | Hill . | |
| 2,935,760 | 5/1960 | Martinec . | |
| 3,085,279 | 4/1963 | Meyerhoefer . | |
| 3,778,863 | 12/1973 | Westergren et al. | 15/323 |
| 3,872,538 | 3/1975 | Crouser . | |
| 3,955,237 | 5/1976 | Chateauneuf et al. . | |
| 4,563,789 | 1/1986 | Berfield . | |
| 4,653,638 | 3/1987 | Lackner et al. . | |
| 5,071,012 | 12/1991 | Jailor . | |
| 5,125,127 | 6/1992 | Bach et al. . | |
| 5,142,731 | 9/1992 | Resch . | |
| 5,303,447 | 4/1994 | McKnight | 15/323 |
| 5,307,537 | 5/1994 | Essex et al. | 15/323 |
| 5,313,686 | 5/1994 | Berfield . | |
| 5,373,606 | 12/1994 | Bosyj et al. | 15/323 |
| 5,826,299 | 10/1998 | Kim | 15/323 |
| 5,850,666 | 12/1998 | Farone et al. | 15/323 X |

*Primary Examiner*—Chris K. Moore
*Attorney, Agent, or Firm*—Howard & Howard

[57] ABSTRACT

An accessory holder for a vacuum cleaner having a base member for supporting a plurality of vacuum accessories. The base member has a pair of arms for attaching the holder to a support structure on the vacuum cleaner. The arms include a tapered wedge projecting from the base member for intermeshing with a tapered channel in the support structure to provide a frictional retaining attachment of the base member to the support structure.The holder further includes a cradle portion extending from the base member for selectively engaging a portion of the vacuum cleaner wand to detachably secure the holder to the wand.

2 Claims, 5 Drawing Sheets

ACCESSORY HOLDER FOR VACUUM CLEANER

BACKGROUND OF THE INVENTION

1. Field of the Invention

The subject invention relates to an accessory holder for a vacuum cleaner apparatus, and more particularly, to an accessory holder having a friction lock connection between the holder and the vacuum.

2. Description of the Related Art

Vacuum cleaner apparatuses commonly include holders for storing accessories for usage with the vacuum such as brushes, crevice tools, extension wands, end fitting, etc.

Often times, the holders are permanently secured to the vacuum and cannot be easily removed, such as disclosed in U.S. Pat. No. 2,935,760 to Martinec, issued May 10, 1960.

Additionally, other holders are of the type which are portable and detachable holders which are independent of the vacuum cleaner. However, these holders cannot be interchangeably attached and detached between the vacuum cleaner housing or base and the vacuum wand or handle to provide easy access to the accessories during use. Such holders are exemplified in U.S. Pat. No. 4,653,638 to Lackner et al., issued Mar. 31, 1987.

It is desirable to provide a detachable accessory holder for a vacuum cleaner apparatus which may be securely retained to the vacuum, yet easily removable for attachment to the wand, hose or handle of the vacuum during use to provide simple access to the accessory tools.

SUMMARY OF THE INVENTION

The subject invention relates to an accessory holder for a vacuum cleaner having a base member for supporting at least one vacuum accessory, said base member having at least one releasable attachment member for attaching the holder to a support structure on the vacuum cleaner. The attachment member includes a tapered wedge projecting from the base member for intermeshing with a tapered channel in the support structure to provide a frictional retaining attachment of the base member to the support structure.

The subject invention further includes a cradle portion extending from the base member for selectively engaging a portion of the vacuum cleaner wand to detachably secure the holder to the wand.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
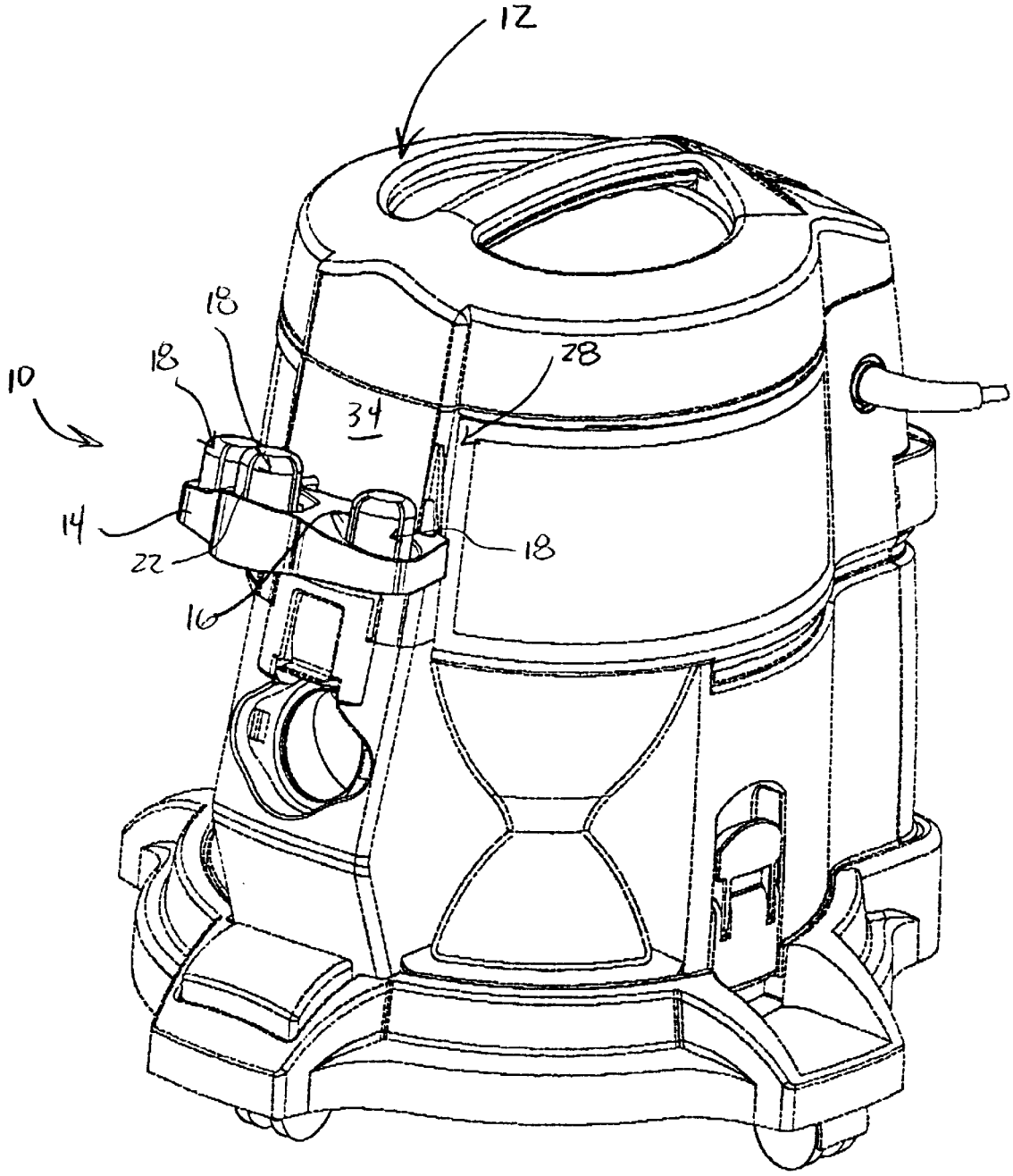
FIG. 1 is a perspective view of a vacuum cleaner apparatus supporting an accessory holder according to the subject invention.
Figure 2:
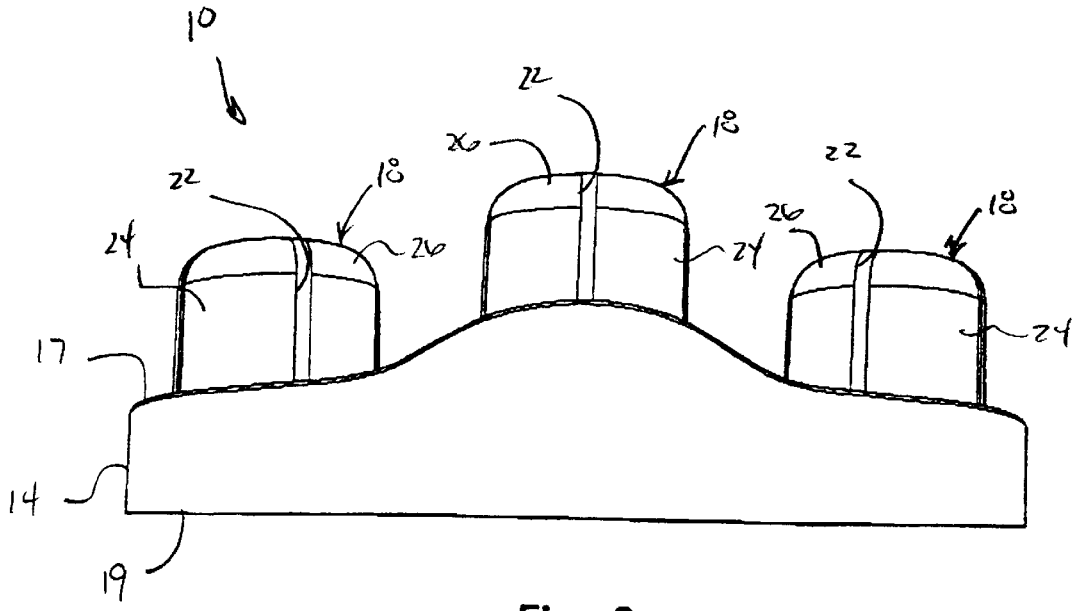
FIG. 2 is a front view of the accessory holder according to the subject invention.
Figure 3:
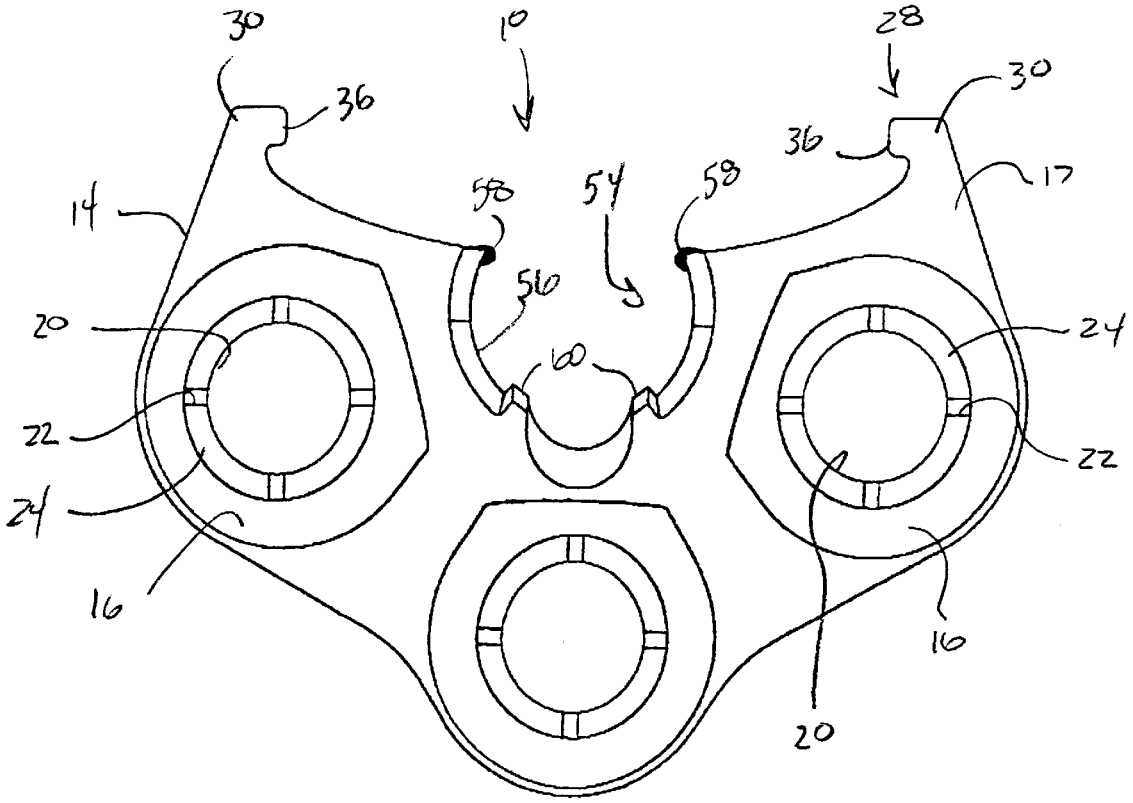
FIG. 3 is a top view of the accessory holder.
Figure 4:
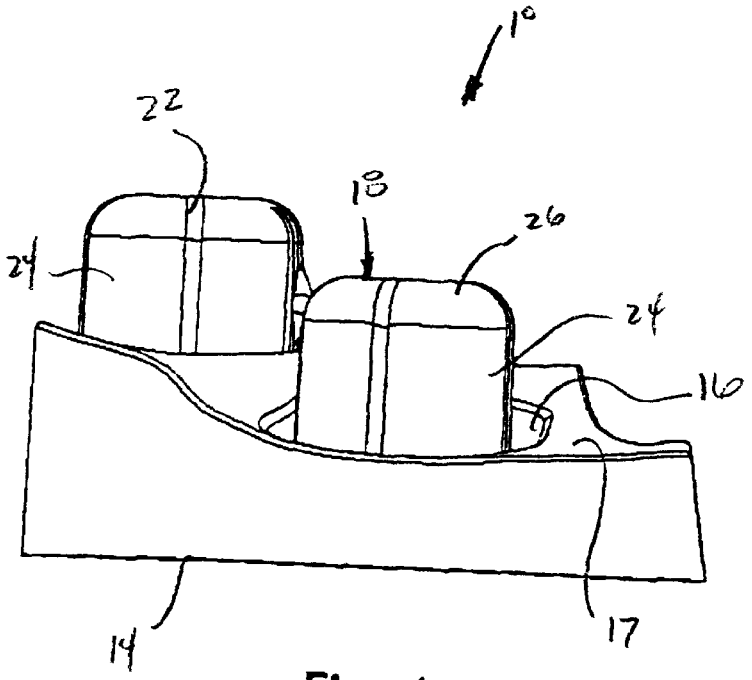
FIG. 4 is a side view of the accessory holder.
Figure 5:
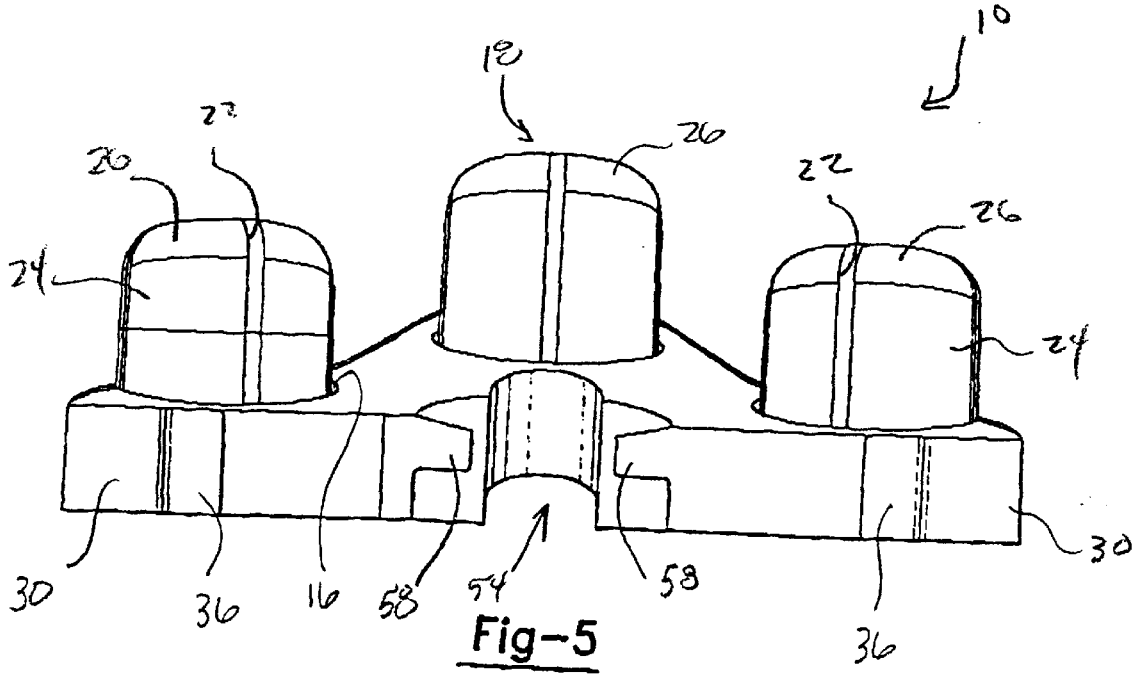
FIG. 5 is a rear view of the accessory holder.

Referring to the Figures, wherein like numerals indicate like or corresponding parts throughout the several views, FIGS. 1–5 disclose an accessory holder 10 for attachment to a vacuum cleaner apparatus 12. The accessory holder 10 includes a base member 14 for support a plurality of vacuum accessories such as a brush, floor and crevice cleaning tool as shown at 15 in FIG. 11. The holder is preferably made of an organic polymeric material and molded as a unitary piece. The base member 14 includes an upper surface 17 and a lower surface 19 and houses a plurality of recessed cavities 16 having a generally cylindrical configuration for recessing a tubular wand attachment part of each of the accessory tools in the base member 14. A bulbous shaped projection 18 is fixedly secured and supported by the base member 14 in the center of each of the cavities 16 and projects upwardly from the base 14 above the perimeter of the cavities 16. The projections 18 are also generally cylindrical and have a circumferential diameter less than the diameter of the cavities 16 so that a space is created therebetween to receive the tubular portion of the accessory tool 15. Each of the bulbous projections 18 is a hollow tube extending from the base member 14 in the cavity 16 to an open distal end 20. Each projection further includes a plurality of longitudinal slots 22 extending from the open distal end 20 to the base 14 which divides the projection 18 into quarter sections 24. Each quarter section 24 has an inwardly curved tip 26 adjacent the open distal end. The curved tips 26 of the projections provides a smooth guideway for aligning and receiving the tubular portion of the accessory tools 15. Further, the quarter sections 24 provide the projections 18 with flexibility about its diameter to accommodate varying sized tubular portions of the tools 15 and also resiliency or elasticity to provide enough friction to retain the tool 15 on the projection 18.

Figure 6:
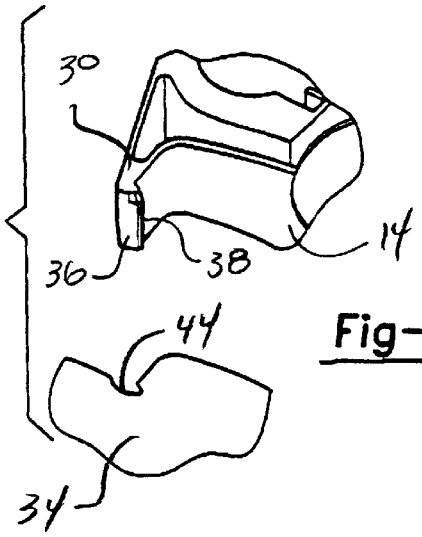
FIG. 6 is a partially broken, top exploded view of the attachment member of the holder and the support structure of the vacuum.
Figure 7:
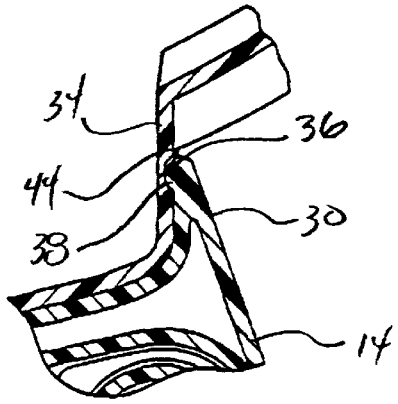
FIG. 7 is a partially broken, cross-sectional view of the attachment member connected to the support structure.
Figure 8:
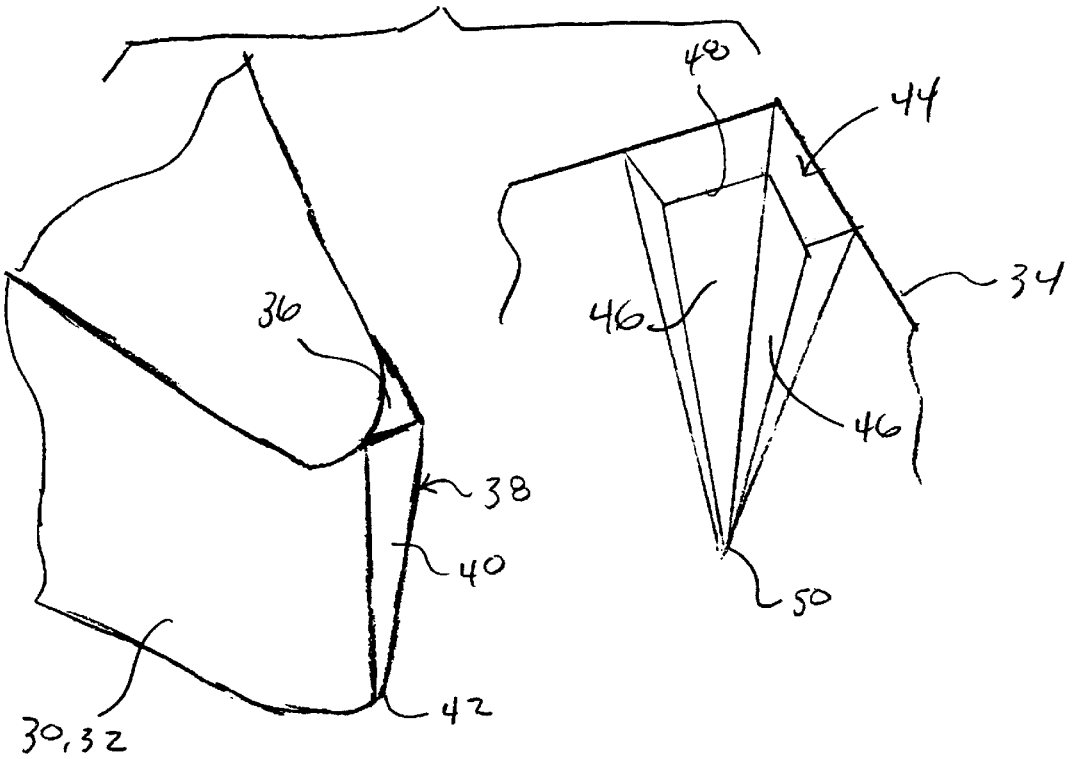
FIG. 8 is a partially broken, exploded view of the tapered wedge and channel.

Referring to FIGS. 6–8, the base member 14 further includes at least one releasable attachment member 28 for attaching the holder 10 to the vacuum 12. The releasable attachment member 28 includes a pair of spaced apart arms 30,32 projecting outwardly from the side of the base member 14, perpendicular to the projections 18 toward a support structure 34 on the vacuum 12. Each arm 30, 32 includes a tap portion 36 projecting inwardly from the corresponding arm 30 in facing relation, that is, one tab 36 projects toward the opposing tab 36. Each tab 36 includes a tapered wedge 38 extending the length of the tab 36 and tapering in width from the top of the tab 36 at the upper surface 17 of the base member 14 to the bottom of the tab 36 at the lower surface 19 of the base member 14. The tapered wedge 38 comprises a plurality of angled surfaces 40 which matingly abut each adjoining surface to decrease the width dimension of the wedge 38 from the top to bottom of the tab 36 until the wedge reaches a point 42 along its bottom.

The support structure 34 on the vacuum cleaner 12 includes a pair of spaced apart tapered channels 44 for receiving the respective tabs 36 therein and providing a frictional retaining attachment of the base member 14 to the support structure 34. Each of the tapered channels 44 similarly include a plurality of angle surfaces 46 which restrict or decrease the width dimension of the channels 44 along the length from the open top 48 of the channel 44 to the closed point bottom 50 of the channel 44.

In operation, to attach the accessory holder 10 to the support structure 34 of the vacuum, the tabs 36 are aligned with the support structure 34 until the tapered wedged 38 are immediately above and aligned with the open top 48 of each tapered channel 44. As the holder 10 is lower into engagement with the support structure 34, the tapered wedges 38 slidably engage the corresponding tapered channels 44. The angle surfaces 40 of the wedges 38 intermesh or press into the angle surfaces 46 of the channels 44 until the holder 10 is frictionally retained against the support structure 34.

Further, as the weight of the accessory tools 15 is added to the holder 10, the tabs 36 and wedges 38 extend further into the channels 44 to provide a tighter frictional fit. Additionally, use and vibrations of the vacuum allow further enhances the frictional fit to prevent movement and vibrational noise from the holder 10.

Figure 9:
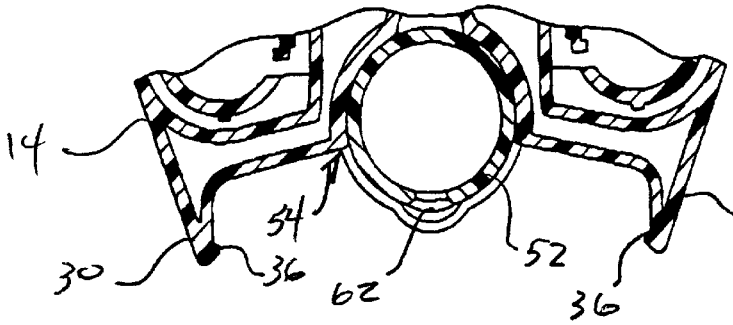
FIG. 9 is a partially broken, cross-sectional top view of the holder attached to a vacuum cleaner wand.
Figure 10:
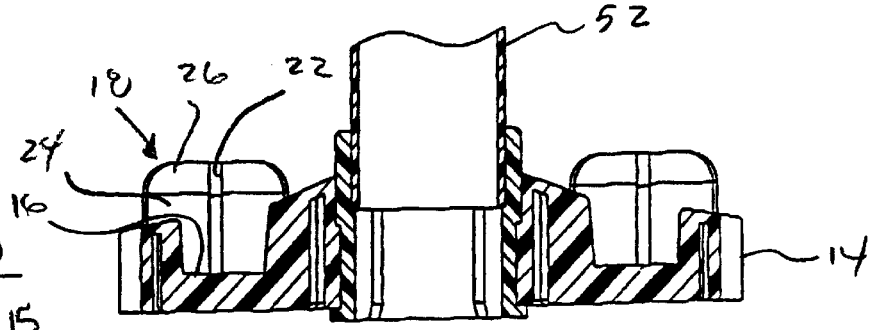
FIG. 10 is a partially broken, cross-sectional side view of FIG. 9.
Figure 11:
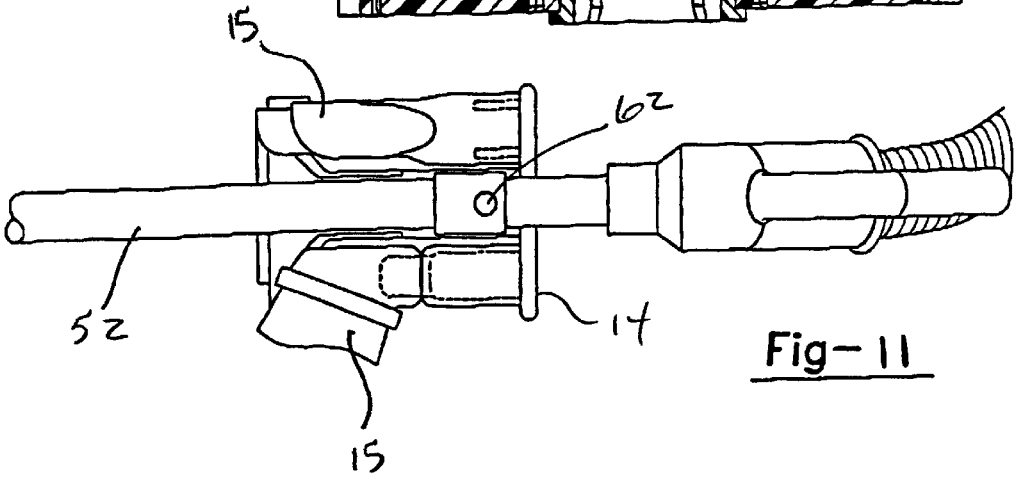
FIG. 11 is an environmental view of the accessory holder attached to the vacuum cleaner wand.

Referring now to FIGS. 3 and 9–11, the holder 10 is shown for use as an attachment onto a wand or handle 52 of the vacuum. The holder 10 includes a cradle portion 54 extending from the base 14 and between the spaced apart arms 30,32. The cradle portion 54 includes a generally U-shaped, cylindrical opening 56 having a pair of detent nubs 58 at opposing ends of the U-shaped opening 56. A second pair of nubs 60 are positioned along the crest of the U-shaped opening 56. The wand 52 includes a spring loaded push button 62 for attachment to a variety of devices or extensions. The holder 10 may be attached to the wand 52 by snapping the cradle portion 54 around the tubular portion of the wand 11, as shown in FIGS. 9–11, with the tubular portion received in the U-shaped opening 56 until the detent nubs 58 grab and retain the wand 52 in the cradle 54. The push button is aligned between the nubs 60 and provides a biasing force of the tubular portion of the wand 52 against the detent nubs 58 to retain the holder 10 around the wand 52. Once attached, the accessory holder 10 is readily accessible to the user for changing of tools 15 as desired.

The invention has been described in an illustrative manner, and it is to be understood that the terminology which has been used is intended to be in the nature of words of description rather than of limitation.

Obviously, many modifications and variations of the present invention are possible in light of the aboveteachings. It is, therefore, to be understood that within the scope of the appended claims, the invention may be practiced otherwise than as specifically described.

What is claimed is:

1. An accessory holder for a vacuum cleaner having a base member for supporting at least one vacuum accessory, said base member having at least one releasable attachment member for attaching said holder to a support structure on the vacuum cleaner; said attachment member including a tapered wedge projecting from said base member for intermeshing with a tapered channel in said support structure to provide a frictional retaining attachment of said base member to said support structure.

2. An accessory holder as set forth in claim 1 further including a cradle portion extending from said base member for selectively engaging a portion of the vacuum cleaner wand to detachably secure said holder to said wand.

* * * * *